US005346041A

United States Patent [19]

Suzuki et al.

[11] Patent Number: 5,346,041

[45] Date of Patent: Sep. 13, 1994

[54] SLIDING EXHAUST BRAKE SYSTEM

[75] Inventors: Ryoichi Suzuki, Mishima; Kazunori Takikawa, Numazu, both of Japan

[73] Assignee: Usui Kokusai Sangyo Kaisha Lyd., Japan

[21] Appl. No.: 645,581

[22] Filed: Jan. 24, 1991

[30] Foreign Application Priority Data

Jan. 29, 1990 [JP] Japan ..... 2-18189

[51] Int. Cl.[5] ..... F02D 9/06

[52] U.S. Cl. ..... 188/273; 137/630.14

[58] Field of Search ..... 188/158, 265, 273; 123/323; 137/630.12, 630.14

[56] References Cited

U.S. PATENT DOCUMENTS

| | | | |
|---|---|---|---|
| 3,624,753 | 11/1971 | Bramm | 137/630.14 |
| 4,205,704 | 6/1980 | Benson | 188/273 X |
| 4,751,987 | 6/1988 | Takigawa et al. | 188/273 |
| 4,805,667 | 2/1989 | Kimura | 137/630.14 |
| 4,848,523 | 6/1989 | Suzuki | 188/273 |
| 4,856,624 | 8/1989 | Usui | 188/273 |

*Primary Examiner*—Robert J. Oberleitner
*Assistant Examiner*—Lee W. Young
*Attorney, Agent, or Firm*—Anthony J. Casella; Gerald E. Hespos

[57] ABSTRACT

There is disclosed an improved sliding exhaust brake system installed on a large vehicle. The brake system comprises a housing, an exhaust gas passage, a main valve member taking the form of a flat plate, one or more exhaust pressure-adjusting holes formed in the main valve member, an auxiliary valve member, and a holding mechanism. The main valve member engages the piston rod of an air cylinder device. The auxiliary valve member can move a given distance relative to the main valve member. When the exhaust gas passage is opened or closed by the main valve member, the auxiliary valve member opens or closes the adjusting holes. At this time, the holding mechanism temporarily prevents relative movement between the the two valve members.

7 Claims, 10 Drawing Sheets

SLIDING EXHAUST BRAKE SYSTEM

BACKGROUND OF THE INVENTION

1. Field of the Invention

The present invention generally relates to a sliding exhaust brake system which is connected to the exhaust pipe of a large-sized vehicle such as a truck or bus and closes off the exhaust gas discharge passage in the exhaust pipe to brake the vehicle when it goes down a steep hill. More particularly, the invention relates to improvements in the structure of the auxiliary valve member included in such a sliding exhaust brake system.

2. Description of the Prior Art

The structure of one known auxiliary valve member used in an exhaust brake system of this kind is shown in FIG. 16, where a valve member 23 takes the form of a flat plate and is provided with a hole 24 for adjusting the exhaust pressure. An auxiliary valve member 30 consists of a liner 29 sliding on the surface of the valve member 30 together with a support frame 28 that supports the liner, The auxiliary valve member 30 is connected with the front end of a piston rod 26 of an actuator such as an air cylinder device or diaphragm device via a block member 25. Thus, the auxiliary valve member 30 can move with the flat valve member 23 after the auxiliary valve member 30 moves a given distance relative to the flat valve member 23. The passage is closed off after the exhaust pressure-adjusting hole 24 is closed by the auxiliary valve member 30. The passage is opened after the adjusting hole 24 is opened.

The structure of another known auxiliary valve member used in an exhaust brake system of this kind is shown in FIG. 17, where a valve member 23 taking the form of a flat plate forms a valve mechanism. A plurality of holes 24, 24', etc. are formed in the bottom surface of the valve member 23 to adjust the exhaust pressure. An auxiliary valve member 27 is mounted on the flat valve member 23 and designed to slide on the surface of the valve member 23. The auxiliary valve member 27 is connected with a piston rod 26 together with the flat valve member 23. A block member 25 is fixed at the front end of the rod 26. The auxiliary valve member 27 can move with the flat valve member 23 after the auxiliary valve member 27 moves a given distance relative to the flat valve member 23 while engaging the block member 25. Holes 28, 28' are formed in the auxiliary valve member 27. When the passage is closed, the exhaust pressure-adjusting holes 24, 24', etc. are closed by the auxiliary valve member 27 in the same way as in the structure described first. The passage is closed after the holes 24, 24' are opened.

In recent years, the output powers of internal combustion engines of automobiles have been increased more and more, and an increasing number of engines are supercharged. That is, engines have tended to be rotated at higher speeds. Therefore, the present situation is that the exhaust pressure and the amount of exhaust gas tend to be increased. With any of the conventional mechanisms described above, however, since the exhaust pressure increases, the obtained smoothness, especially responsiveness, tends to be insufficient especially when the exhaust passage is closed. In particular, in order to close off the passage, the exhaust pressure-adjusting hole 24 or holes 24, 24', etc. are first closed. Under this condition, the valve member 23 is moved to close off the exhaust passage. As a result, the aforementioned undesirable phenomena tend to occur. To avoid these problems, the actuator has had to be made larger.

SUMMARY OF THE INVENTION

It is an object of the invention to provide a sliding exhaust brake system which, when the passage is closed, actuates an auxiliary valve member as described above while opening the exhaust pressure-adjusting hole or holes to release a part of the exhaust gas from the pressure-adjusting holes for suppressing the rate at which the exhaust pressure increases and, at the same time, closing the exhaust gas passage, whereby the gas passage can be sufficiently smoothly and quickly closed with good response even to high exhaust pressure and to large amounts of exhaust gas.

The above object is achieved by a sliding exhaust brake system having an exhaust gas passage and comprising: a housing forming the body of the exhaust brake system and having connecting protruding walls at its both ends, the protruding walls being connected with an exhaust pipe, the housing being provided with a path extending substantially at right angles to the exhaust gas passage; a valve member taking the form of a flat plate, the valve member being capable of moving back and forth in said path, the valve member being provided with one or more exhaust pressure-adjusting holes, the valve member being mounted in the housing in such a way that the valve member engages the piston rod of an air cylinder device connected with the body; an auxiliary switching mechanism which can move a given distance relative to the valve member and which, when the exhaust gas passage is opened or closed, opens or closes the exhaust pressure-adjusting hole or holes; and a holding mechanism which, when the exhaust gas passage is closed off by the valve member, temporarily prevents the relative movement between the valve member and the auxiliary switching mechanism.

In this novel structure, when the exhaust gas passage is closed off by the valve member, the relative movement between the valve member and the auxiliary switching mechanism is temporarily prevented by the holding mechanism. When the exhaust pressure-adjusting hole or holes are open, the exhaust gas passage is closed by both valve member and auxiliary switching mechanism which move together. Meanwhile, some of the exhaust gas from the adjusting hole or holes is released to suppress increases in the the exhaust pressure. After the passage is completely closed off by making the top portion of the valve member bear against the bottom wall of the housing, the movable part of the auxiliary switching mechanism disengages from the body of the switching mechanism and slightly moves forward to close the exhaust pressure-adjusting holes in the valve member. When the passage is opened, the exhaust pressure-adjusting hole or holes are opened with certainty. Hence, the valve member opens the hole or holes smoothly.

Consequently, the exhaust gas passage can be closed sufficiently smoothly and with good response without requiring a large-sized and powerful actuator such as a cylinder device or diaphragm device driving the valve mechanism or making the assembly large.

DETAILED DESCRIPTION OF THE PREFERRED EMBODIMENTS

Figure 1A:
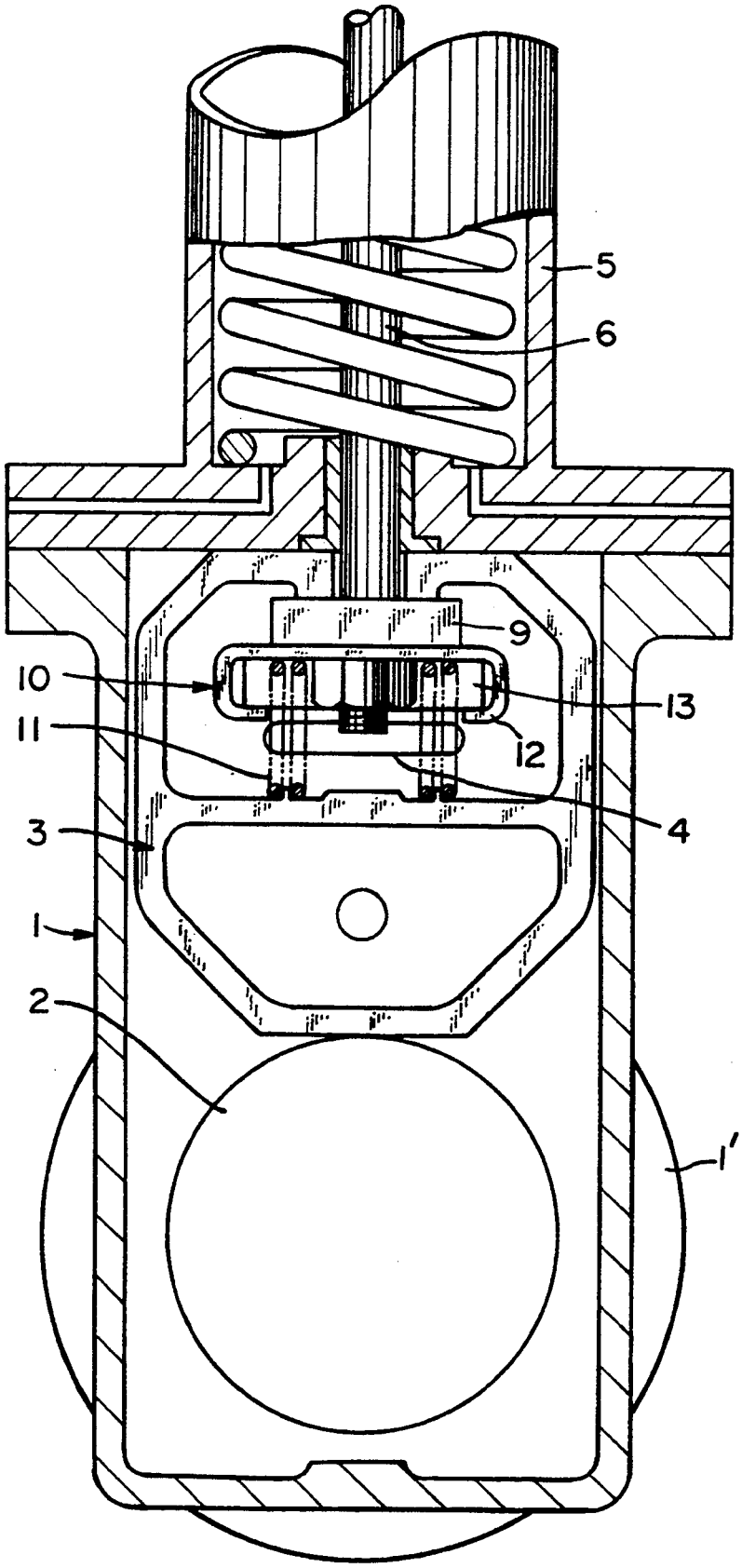
FIG. 1A is a partially cutaway plan view of a sliding exhaust brake system according to the invention.

Referring to FIGS. 1A, 1B, 2–15, there is shown a sliding exhaust brake according to the invention. The body of the brake has a housing 1. Connecting walls 1' protrude from both ends of the housing 1. The connecting walls 1' are connected with an exhaust pipe (not shown). The housing 1 has an exhaust gas passage 2. A valve member 3 taking the form of a flat plate can move back and forth in a path which is in communication with the gas passage 2 and extends substantially at right angles to the passage 2. One exhaust pressure-adjusting hole 4 ( FIG. 1A ) or plural exhaust pressure-adjusting holes 4, 4', 4'', etc. (FIG. 1B) extend through the bottom wall of the valve member 3. The valve member 3 engages a piston rod 6 near its front end. The rod 6 extends through the partition wall of an air cylinder device 5 connected with the upper end of the path.

An auxiliary valve member 10 ( FIG. 1A ) consists of a support frame 12 of a C-shaped cross section and a liner 13 sliding on the surface of the valve member 3. The frame 12 is mounted to the front surface of a block member 9 which engages the valve member 3 located near the front end of the piston rod 6. The liner 13 that is mounted inside the frame 12 and pressed down from above near the longitudinal central position and urged into intimate contact with the loosely inserted valve member 3.

The auxiliary valve member 10 can be replaced by an auxiliary valve member 7 (FIG. 1B) mounted on the valve member 3. The side walls of the auxiliary valve member 7 are made to engage the piston rod 6 together with the valve member 3. The block member 9 that is fixed to the front end of the piston rod is anchored to the auxiliary valve member 7. The auxiliary valve member 7 is mounted on the rod 6 with a slight clearance such that the valve member 7 can be pushed into intimate contact with the valve member 3 by the pressure of the exhaust gas and that the valve member 7 can be actuated by the operation of the rod 6. A plurality of holes 8, 8', etc. extend through the bottom wall of the valve member 7 and are located in such a way that they are in communication with the exhaust pressure-adjusting holes 4, 4', 4'', etc. in the valve member 3. The auxiliary valve member 7 can slide directly on the surface of the valve member 3.

A mechanism 11 (FIG. 1A) for holding the auxiliary valve member 10 is located in such a position that the block member 9 can withdrawably bear against the side walls of the valve member 3. A mechanism 11 (FIG. 1B) for holding the auxiliary valve member 7 is located in such a position that the block member 9 can withdrawably bear against the side walls of the auxiliary valve member 7.

In the example shown in FIG. 1A, when the exhaust gas passage 2 is closed off by the valve member 3, the exhaust pressure-adjusting holes 4 are opened by the holding mechanism 11. Under this condition, the relative movement between the valve member 3 and the auxiliary valve member 10 is prevented temporarily; rather they are moved together to close off the exhaust gas passage 2. Meanwhile, some of the exhaust gas from the adjusting holes is kept released to suppress the rate at which the exhaust pressure increases during the operation. After the passage is completely closed off by making the top portion of the valve member 3 bear against the bottom wall of the housing 1, the auxiliary valve member 10 pushes the holding mechanism 11 and moves forward slightly to close the adjusting holes 4. On the other hand, when the passage is opened, the auxiliary valve member 10 moves rearward slightly to open the adjusting holes 4, thus releasing some of the exhaust gas. This lowers the exhaust pressure. Springs mounted in the air cylinder device 5 cooperate with the holding mechanism 11 to maintain the block member 9 in abutment with the valve member 3. As a result, the block member 9 opens the passage along with the valve member 3.

Figure 1B:
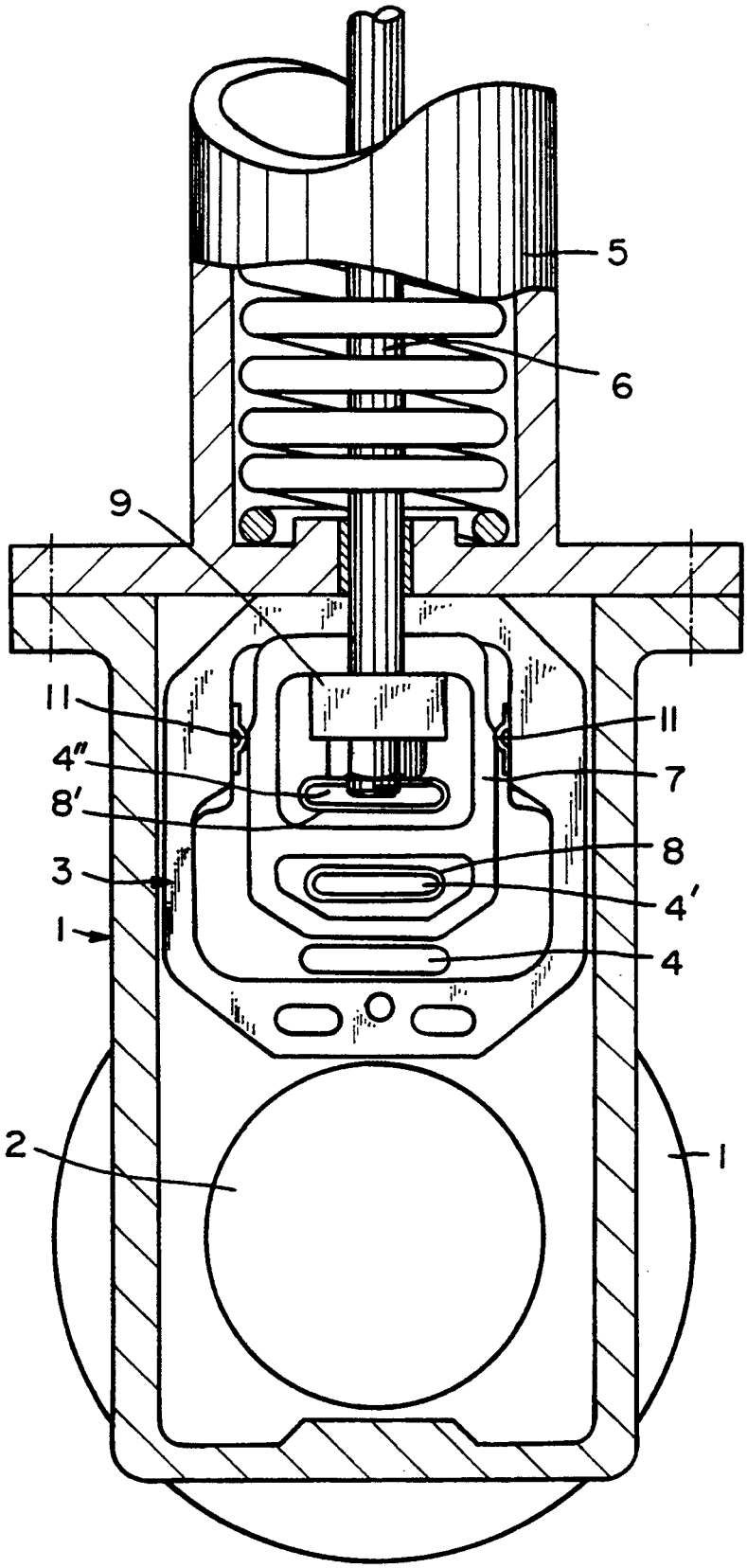
FIG. 1B is a view similar to FIG. 1A, but showing another sliding exhaust brake system according to the invention.
Figure 2:
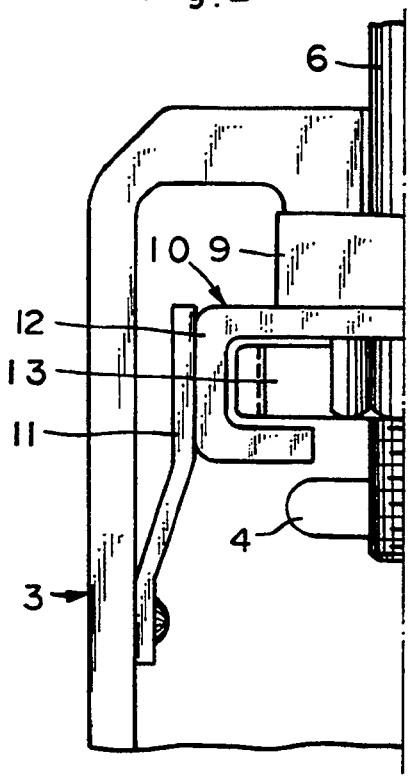
FIGS. 2–12 are partially cutaway plan views of other examples of the holding mechanism shown in FIG. 1A.
Figure 3:
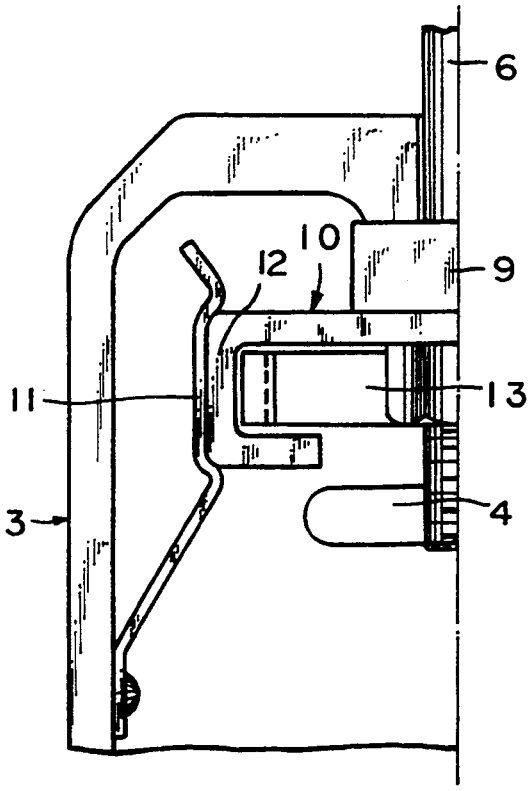
Figure 4:
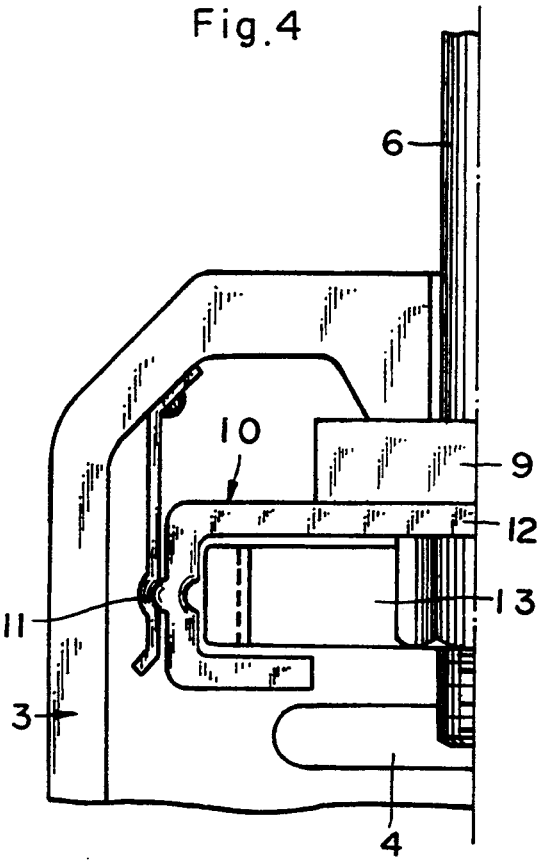
Figure 5:
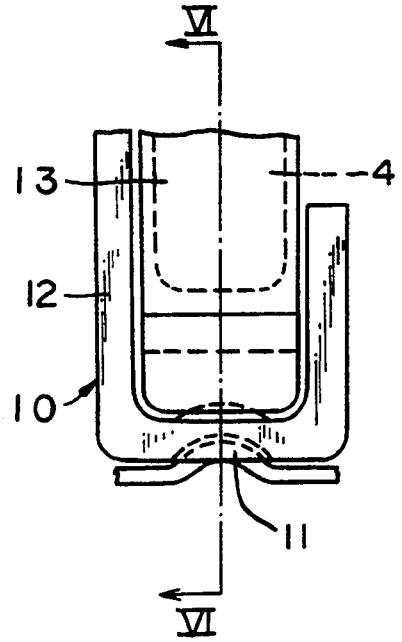
Figure 6:
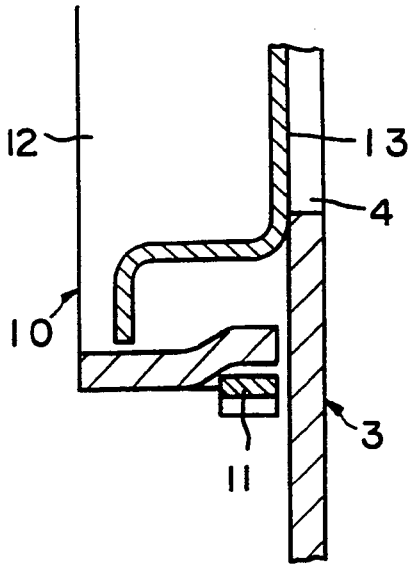
Figure 7:
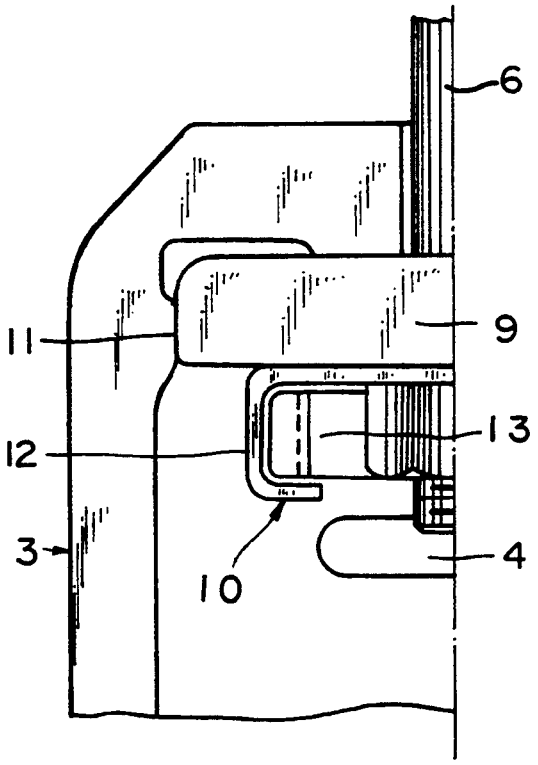
Figure 8:
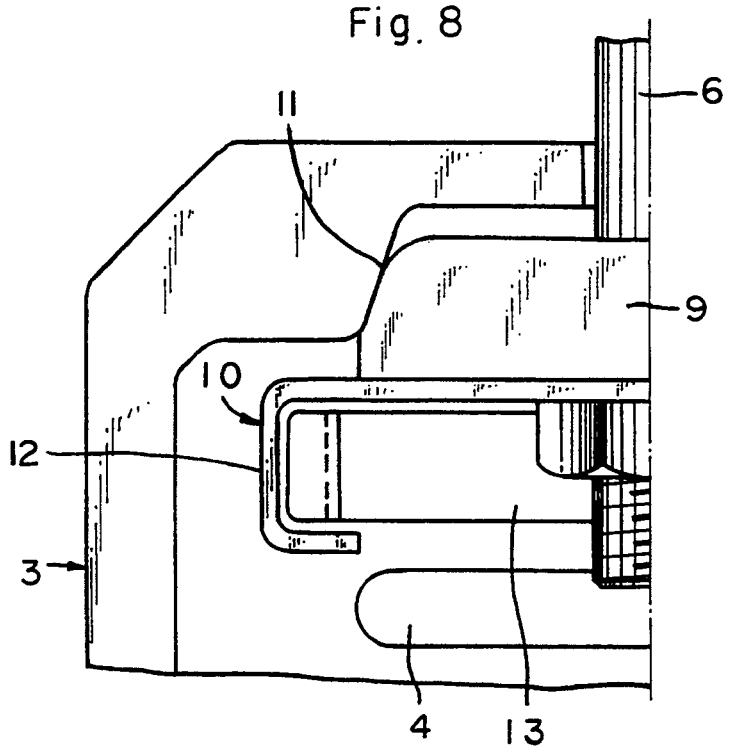
Figure 9:
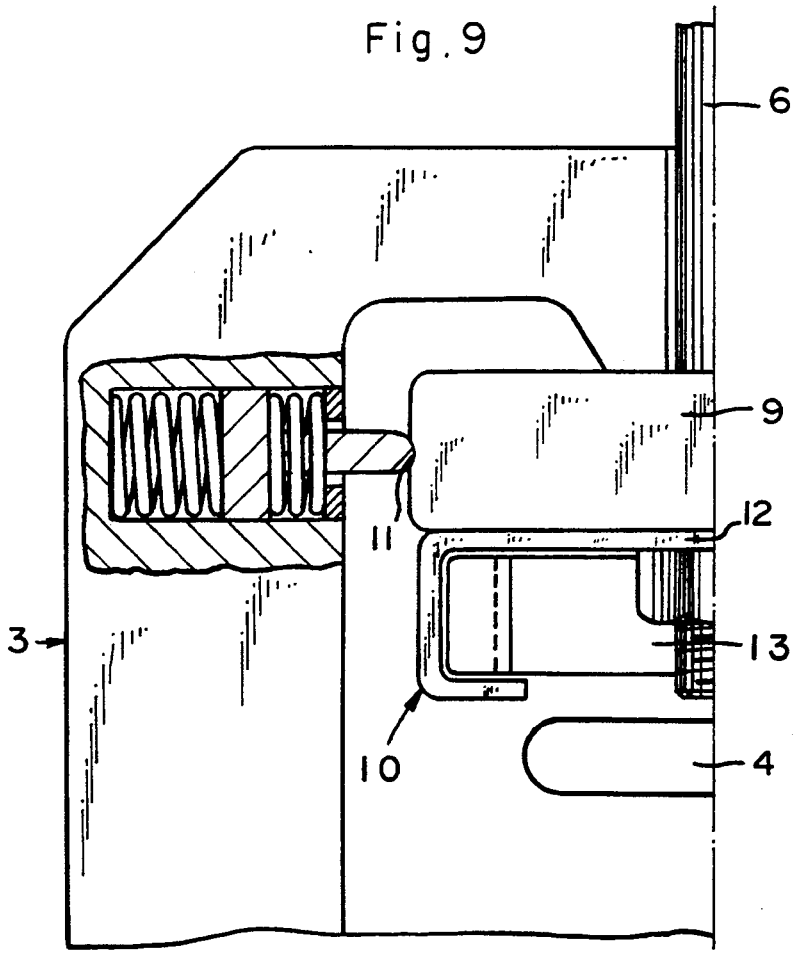
Figure 10:
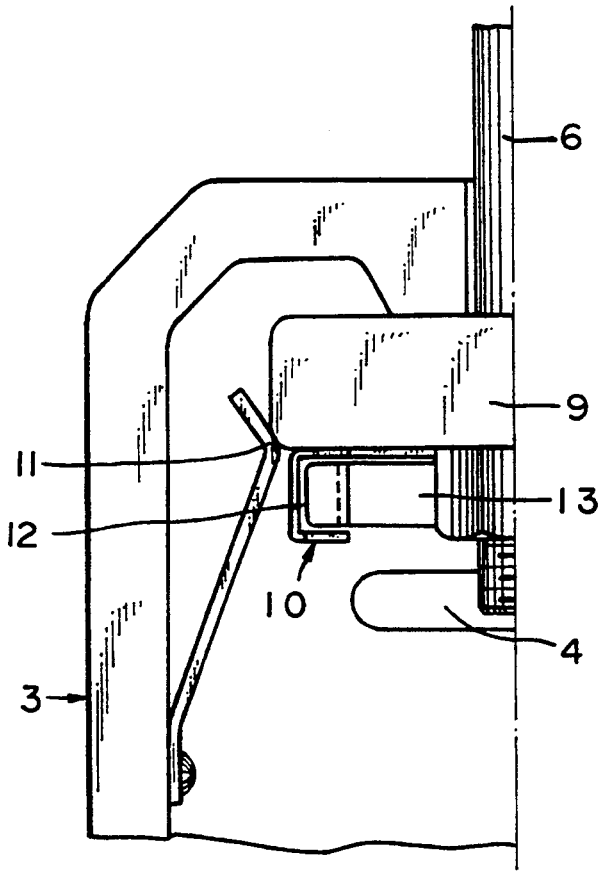
Figure 11:
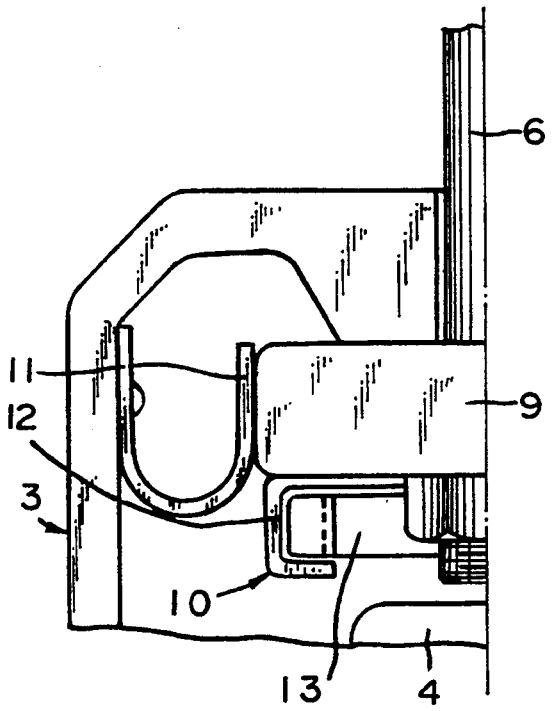
Figure 12:
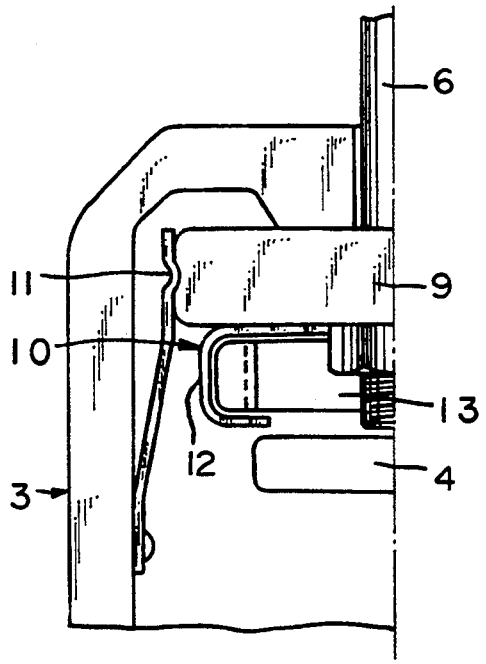

In the example shown in FIG. 1B, when the exhaust gas passage 2 is closed by the valve member 3, the holding mechanism 11 temporarily prevents the relative movement between the valve member 3 and the auxiliary valve member 7. These valve members move together to close the exhaust gas passage 2 while opening the exhaust pressure-adjusting holes 4, 4', etc. Meanwhile, some of the exhaust gas from the adjusting holes is permitted to escape, for suppressing increases in the exhaust pressure. After the passage is closed off completely by making the top portion of the valve member 3 bear against the bottom wall of the housing 1, the auxiliary valve member 7 disengages from the holding mechanism 11 and moves forward slightly to close the exhaust pressure-adjusting holes 4, 4', etc. When the passage is opened, the auxiliary valve member 7 moves rearward slightly to open the holes, thus releasing some of the exhaust gas. In this way, the exhaust pressure is lowered. The auxiliary valve member 7 is caused to engage the holding mechanism 11 and held on it. These valve members together open the passage.

Figure 13:
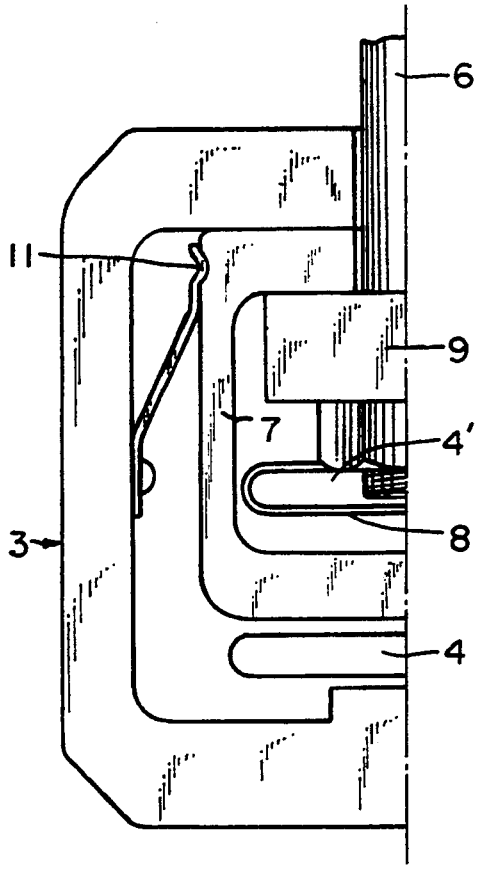
FIGS. 13–15 are partially cutaway plan views of other examples of the holding mechanism shown in FIG. 1B.
Figure 14:
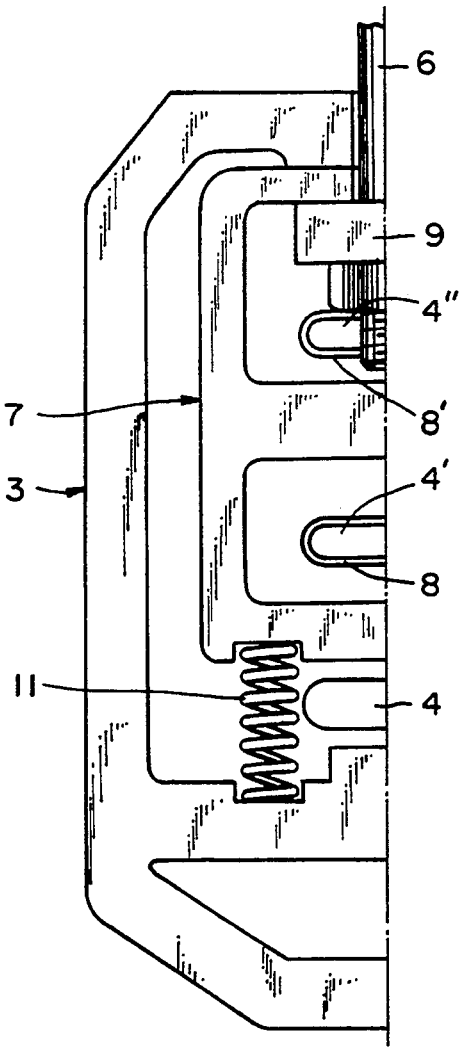
Figure 15:
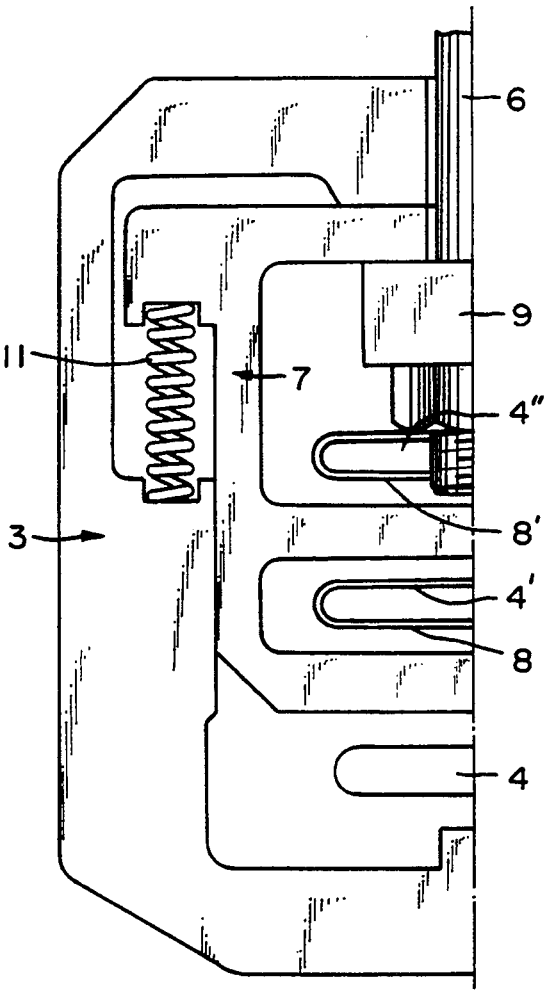
Figure 16:
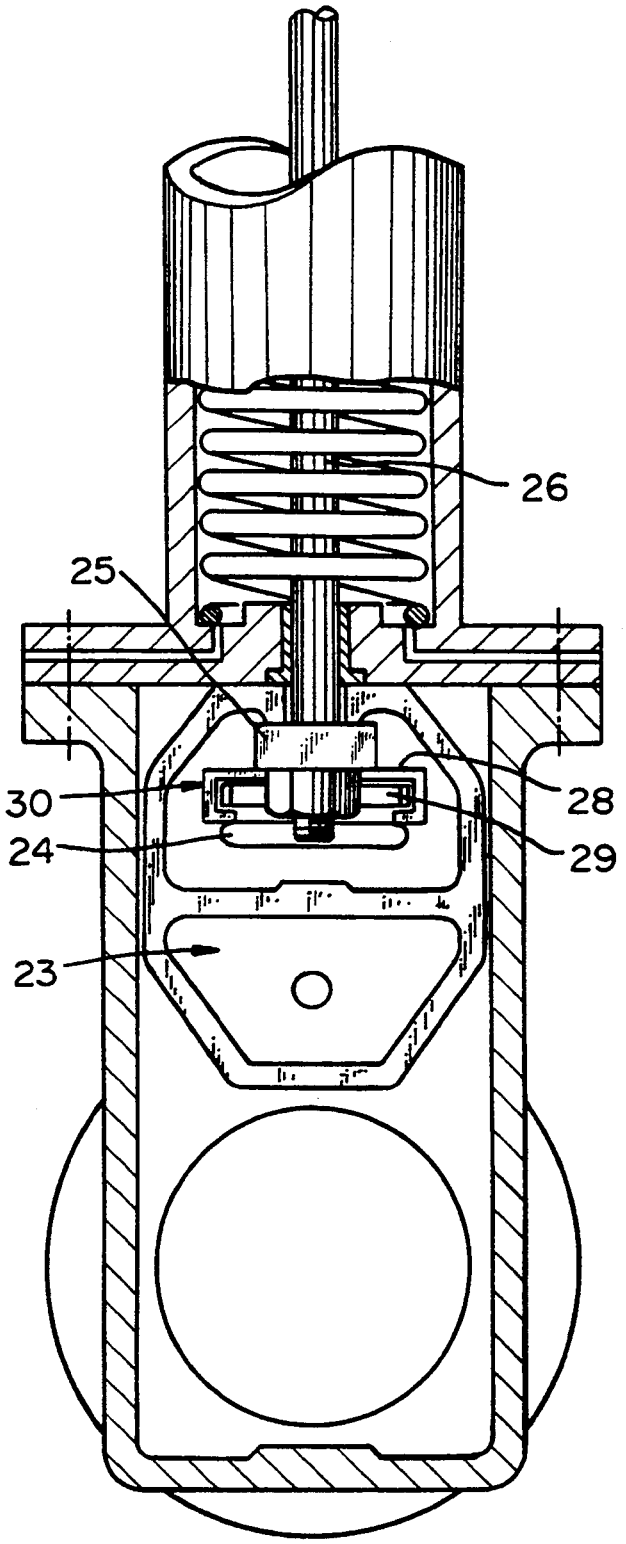
Fig. 16 PRIOR ART
FIGS. 16 and 17 are partially cutaway plan views of conventional sliding exhaust brake systems.
Figure 17:
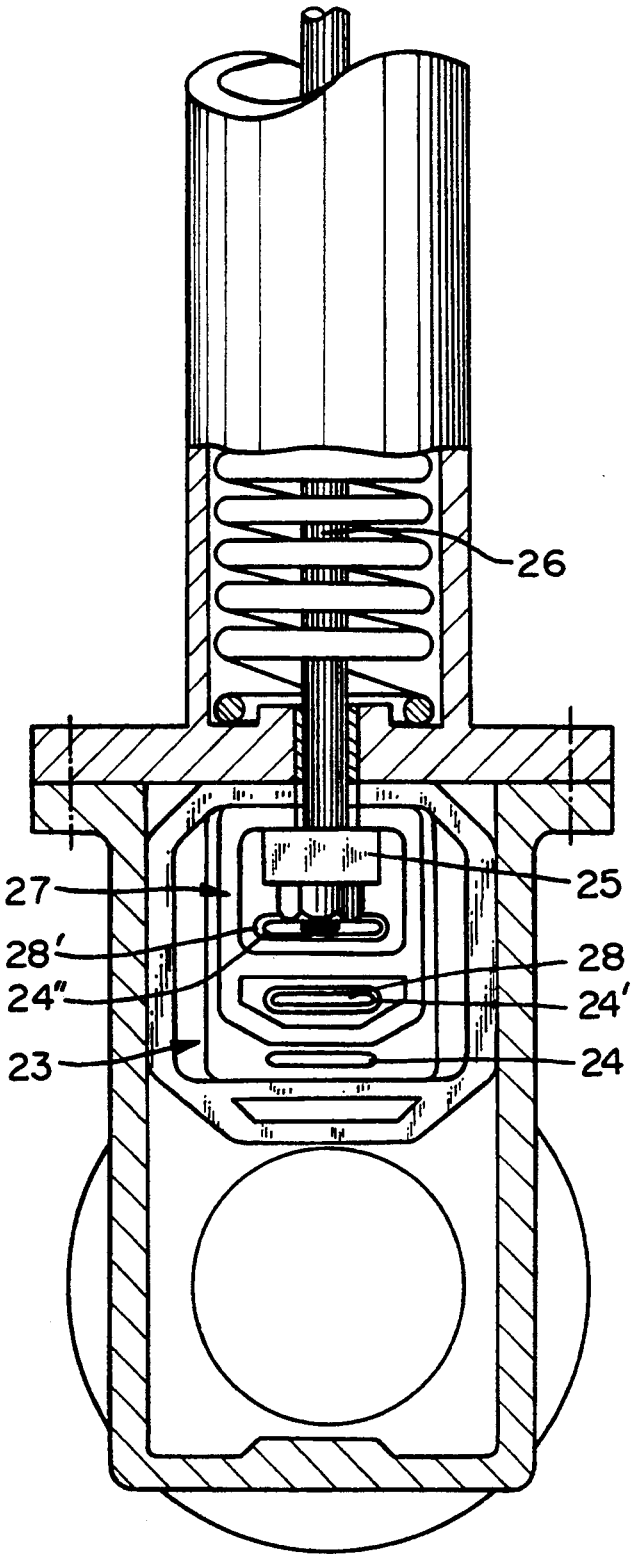
Fig. 17 PRIOR ART

The holding mechanism 11 can assume various forms. Those examples which have the auxiliary valve member 10 are shown in FIGS. 2–12. Those examples which have the auxiliary valve member 7 are shown in FIGS. 13–15. In the examples shown in FIGS. 2–6, a spring member taking the form of a flat plate is riveted at its one end to the valve member 3 and supports the support frame 12. In the examples shown in FIGS. 10–12, a spring member taking the form of a flat plate is riveted at its one end to the block member 9. In the example shown i n FIG. 7, the block member 9 engages the outer surfaces of the side walls of the valve member 3 to thereby support it. In the example shown in FIG. 8, the surfaces of the valve member 3 and of the block member 9 which bear against each other make tapering frictional surfaces. In the example shown in FIG. 9, the side wall surfaces of the valve member 3 have resilient protrusions which support the block member 9. In the example shown in FIG. 13, a spring member taking the form of a flat plate is riveted at its one end to the auxiliary valve member 7 and supports it. In the examples shown in FIGS. 14 and 15, a plurality of spring members are stretched in the direction in which the valve member 3 and the auxiliary valve member 7 move relative to each other. The spring members support these two valve members.

As described thus far, in the novel sliding exhaust brake system, when the exhaust gas passage 2 is closed off, the holding mechanism 11 is provided to temporarily prevent relative movement between the valve member 3 and the auxiliary valve member 10 or 7. Therefore, especially when the exhaust gas passage 2 is closed by the valve member 3, the auxiliary valve member is moved with the valve member 3 while opening the exhaust pressure-adjusting hole 4 or holes 4, 4', etc. Meanwhile, some of the exhaust gas from the adjusting holes is kept released to suppress the rate at which the exhaust pressure increases. In this way, the valve is closed. Consequently, the exhaust gas passage 2 can be closed sufficiently smoothly and quickly without the need to make larger or more powerful the actuator such as the cylinder device 5 or the diaphragm device driving the valve or the whole assembly even if the exhaust gas pressure or the amount of the exhaust gas is increased because the output power of the engine is increased, the engine is supercharged to a greater extent, or it is rotated at higher speeds. Hence, the novel sliding exhaust brake system produces large braking force and provides quite high responsiveness.

What is claimed is:

1. A sliding exhaust brake system comprising:

a housing having an exhaust gas passage and a path extending substantially at right angles to the exhaust gas passage;

a valve member comprising a flat plate, the valve member being capable of moving back and forth in said path into and out of the exhaust gas passage, the valve member being provided with at least one exhaust pressure-adjusting hole, the valve member being mounted in the housing in such a way that the valve member engages a piston rod of an air cylinder device connected with the housing;

an auxiliary switching mechanism which can move a given distance relative to the valve member and which, when the exhaust gas passage is opened, opens the at least one exhaust pressure-adjusting hole, and when the exhaust gas passage is closed, closes the at least one exhaust pressure-adjusting hole, said auxiliary switching mechanism comprising: a support frame having a C-shaped cross section and mounted to a front surface of a block member engaging the valve member near an end of the piston rod remote from the cylinder; and a liner loosely inserted in the frame and sliding on the flat plate of the valve member while making intimate contact with the flat plate of the valve member; and a holding mechanism which, during the closing of the exhaust gas passage by the valve member, prevents the relative movement between the valve member and the auxiliary switching mechanism until the exhaust gas passage is substantially completely closed by the valve member, said holding mechanism comprising a spring member taking the form of a flat plate engageable with the support frame, one end of the spring member being fixed to the valve member, the support frame being supported by the spring member, whereby the exhaust gas passage can be sufficiently smoothly and quickly closed by the valve member for achieving good response to high exhaust gas pressure in the exhaust gas passage.

2. A sliding exhaust brake system comprising:

a housing having an exhaust gas passage a path extending substantially at right angles to the exhaust gas passage;

a valve member comprising a flat plate, the valve member being capable of moving back and forth in said path into and out of the exhaust gas passage, the valve member being provided with at least one exhaust pressure-adjusting hole, the valve member being mounted in the housing in such a way that the valve member engages a piston rod of an air cylinder device connected with the housing;

an auxiliary switching mechanism which can move a given distance relative to the valve member and which, when the exhaust gas passage is opened, opens the at least one exhaust pressure-adjusting hole, and when the exhaust gas passage is closed, closes the at least one exhaust pressure-adjusting hole, said auxiliary switching mechanism comprising: a support frame having a C-shaped cross section and mounted to a front surface of a block member engaging the valve member near an end of the piston rod remote from the cylinder; and a liner loosely inserted in the frame and sliding on the flat plate of the valve member while making intimate contact with the flat plate of the valve member; and a holding mechanism which, during the closing of the exhaust gas passage by the valve member, prevents the relative movement between the valve member and the auxiliary switching mechanism until the exhaust gas passage is substantially completely closed by the valve member, said holding mechanism comprising a spring member taking the form of a flat plate engageable with the block member, the block member being supported by the spring member, whereby the exhaust gas passage can be sufficiently smoothly and quickly closed by the valve member for achieving good response to high exhaust gas pressure in the exhaust gas passage.

3. A sliding exhaust brake system comprising:

a housing having an exhaust gas passage a path extending substantially at right angles to the exhaust gas passage;

a valve member comprising a flat plate and a plurality of side walls extending from the flat plate, the valve member being capable of moving back and forth in said path into and out of the exhaust gas passage, the valve member being provided with at least one exhaust pressure-adjusting hole, the valve member being mounted in the housing in such a way that the valve member engages a piston rod of an air cylinder device connected with the housing;

an auxiliary switching mechanism which can move a given distance relative to the valve member and which, when the exhaust gas passage is opened, opens the at least one exhaust pressure-adjusting hole, and when the exhaust gas passage is closed, closes the at least one exhaust pressure-adjusting hole, said auxiliary switching mechanism comprising: a support frame having a C-shaped cross section and mounted to a front surface of a block member engaging the valve member near an end of the piston rod remote from the cylinder; and a liner loosely inserted in the frame and sliding on the flat plate of the valve member while making intimate contact with the flat plate of the valve member; and a holding mechanism which, during the closing of the exhaust gas passage by the valve member, prevents the relative movement between the valve member and the auxiliary switching mechanism until the exhaust gas passage is substantially completely closed by the valve member, said holding mechanism comprising means for causing the block member to engage surfaces of the side walls of the valve members, whereby the exhaust gas passage can be sufficiently smoothly and quickly closed by the valve member for achieving good response to high exhaust gas pressure in the exhaust gas passage.

4. A sliding exhaust brake system comprising:

a housing having an exhaust gas passage a path extending substantially at right angles to the exhaust gas passage;

a valve member comprising a flat plate, the valve member being capable of moving back and forth in said path into and out of the exhaust gas passage, the valve member being provided with at least one exhaust pressure-adjusting hole, the valve member being mounted in the housing in such a way that the valve member engages a piston rod of an air cylinder device connected with the housing;

an auxiliary switching mechanism which can move a given distance relative to the valve member and which, when the exhaust gas passage is opened, opens the at least one exhaust pressure-adjusting hole, and when the exhaust gas passage is closed, closes the at least one exhaust pressure-adjusting hole, said auxiliary switching mechanism comprising: a support frame having a C-shaped cross section and mounted to a front surface of a block member engaging the valve member near an end of the piston rod remote from the cylinder; and a liner loosely inserted in the frame and sliding on the flat plate of the valve member while making intimate contact with the flat plate of the valve member; and a holding mechanism which, during the closing of the exhaust gas passage by the valve member, prevents the relative movement between the valve member and the auxiliary switching mechanism until the exhaust gas passage is substantially completely closed by the valve member, said holding mechanism comprising tapering frictional surfaces which are formed on surfaces of the valve member and of the block member which bear against each other, whereby the exhaust gas passage can be sufficiently smoothly and quickly closed by the valve member for achieving good response to high exhaust gas pressure in the exhaust gas passage.

5. A sliding exhaust brake system comprising:

a housing having an exhaust gas passage and a path extending substantially at right angles to the exhaust gas passage;

a valve member comprising a flat plate and a plurality of side walls extending from the flat plate, the valve member being capable of moving back and forth in said path into and out of the exhaust gas passage, the valve member being provided with at least one exhaust pressure-adjusting hole, the valve member being mounted in the housing in such a way that the valve member engages a piston rod of an air cylinder device connected with the housing;

an auxiliary switching mechanism which can move a given distance relative to the valve member and which, when the exhaust gas passage is opened, opens the at least one exhaust pressure-adjusting hole, and when the exhaust gas passage is closed, closes the at least one exhaust pressure-adjusting hole, said auxiliary switching mechanism comprising: a support frame having a C-shaped cross section and mounted to a front surface of a block member engaging the valve member near an end of the piston rod remote from the cylinder; and a liner loosely inserted in the frame and sliding on the flat plate of the valve member while making intimate contact with the flat plate of the valve member; and a holding mechanism which, during the closing of the exhaust gas passage by the valve member, prevents the relative movement between the valve member and the auxiliary switching mechanism until the exhaust gas passage is substantially completely closed by the valve member, wherein said holding mechanism comprises resilient protrusions formed at side wall surfaces of the valve member for holding the block member, whereby the exhaust gas passage can be sufficiently smoothly and quickly closed by the valve member for achieving good response to high exhaust gas pressure in the exhaust gas passage.

6. A sliding exhaust brake system comprising:

a housing having an exhaust gas passage and a path extending substantially at right angles to the exhaust gas passage;

a valve member comprising a flat plate, the valve member being capable of moving back and forth in said path into and out of the exhaust gas passage, the valve member being provided with at least one exhaust pressure-adjusting hole, the valve member being mounted in the housing in such a way that the valve member engages a piston rod of an air cylinder device connected with the housing;

an auxiliary switching mechanism slidably mounted on the flat plate of the valve member and engaged by a block member fixed to an end of the piston rod remote from the cylinder, the auxiliary switching mechanism having at least one hole registerable with the at least one exhaust pressure adjusting hole of the valve member, the auxiliary switching mechanism being movable a given distance relative to the valve member and which, when the exhaust gas passage is opened, opens the at least one exhaust pressure-adjusting hole, and when the exhaust gas passage is closed, closes the at least one exhaust pressure-adjusting hole; and a holding mechanism which, during the closing of the exhaust gas passage by the valve member, prevents the relative movement between the valve member and the auxiliary switching mechanism until the exhaust gas passage is substantially completely closed by the valve member, said holding mechanism comprising a spring member taking the form of a flat plate engageable with the auxiliary switching mechanism, one end of the spring member being fixed to the valve member, the auxiliary switching mechanism being supported by the spring member, whereby the exhaust gas passage can be sufficiently smoothly and quickly closed by the valve member for achieving good response to high exhaust gas pressure in the exhaust gas passage.

7. A sliding exhaust brake system comprising:

a housing having an exhaust gas passage a path extending substantially at right angles to the exhaust gas passage;

a valve member comprising a flat plate, the valve member being capable of moving back and forth in said path into and out of the exhaust gas passage, the valve member being provided with at least one exhaust pressure-adjusting hole, the valve member being mounted in the housing in such a way that the valve member engages a piston rod of an air cylinder device connected with the housing;

an auxiliary switching mechanism which can move a given distance relative to the valve member and which, when the exhaust gas passage is opened, opens the at least one exhaust pressure-adjusting hole, and when the exhaust gas passage is closed, closes the at least one exhaust pressure-adjusting hole, said auxiliary switching mechanism comprising: a support frame having a C-shaped cross section and mounted to a front surface of a block member engaging the valve member near an end of the piston rod remote from the cylinder; and a liner loosely inserted in the frame and sliding on the flat plate of the valve member while making intimate contact with the flat plate of the valve member; and a holding mechanism which, during the closing of the exhaust gas passage by the valve member, temporarily prevents the relative movement between the valve member and the auxiliary switching mechanism until the exhaust gas passage is substantially completely closed by the valve member, said holding mechanism comprising a spring member extending from the valve member to a portion of the support frame opposite the block member, whereby the exhaust gas passage can be sufficiently smoothly and quickly closed by the valve member for achieving good response to high exhaust gas pressure in the exhaust gas passage.

* * * * *